United States Patent [19]

Newman

[11] Patent Number: 4,766,776

[45] Date of Patent: Aug. 30, 1988

[54] SINGLE CABLE SHIFT ASSEMBLY

[75] Inventor: Neil A. Newman, Omro, Wis.

[73] Assignee: Brunswick Corporation, Skokie, Ill.

[21] Appl. No.: 96,948

[22] Filed: Sep. 15, 1987

[51] Int. Cl.[4] ..... B63H 21/21; B63H 21/26

[52] U.S. Cl. ..... 74/501 A; 74/108; 74/480 B; 74/501 F; 440/86; 440/87

[58] Field of Search ..... 74/480 R, 480 B, 108, 74/501 A, 501 F; 440/84, 86, 87

[56] References Cited

U.S. PATENT DOCUMENTS

| | | | |
|---|---|---|---|
| 2,651,278 | 9/1953 | Davison et al. | 74/480 B X |
| 3,002,398 | 10/1961 | Beamer | 74/480 B X |
| 3,021,722 | 2/1962 | Bratz et al. | 74/480 B X |
| 3,088,449 | 5/1963 | Hockaday et al. | 74/501 A |
| 3,139,254 | 6/1964 | Voorhees | 74/480 B X |
| 3,143,994 | 8/1964 | Morse | 74/480 B X |
| 3,417,723 | 12/1968 | Akermanis | 74/480 B X |
| 4,323,356 | 4/1982 | Stephenson | 440/86 |

FOREIGN PATENT DOCUMENTS

| | | | |
|---|---|---|---|
| 388963 | 11/1973 | U.S.S.R. | 440/84 |

*Primary Examiner*—Allan D. Herrmann

*Attorney, Agent, or Firm*—Andrus, Sceales, Starke & Sawall

[57] ABSTRACT

A single cable shift assembly includes a casing (30) mounted to a surface adjacent the pull-pull cables (14, 16) of a shift/throttle control linkage. A pair of pulleys (34, 36) direct cables (14, 16) in opposite directions. A slide (38) within casing (30) includes anchors (40, 42) for securing the cable ends to spaced positions along the longitudinal axis of the slide. The slide is provided with a connector pin (44) that secures the control cable (48) to the slide and translates linear movement of the control cable into linear movement of the slide.

7 Claims, 3 Drawing Sheets

SINGLE CABLE SHIFT ASSEMBLY

BACKGROUND OF THE INVENTION

The present invention relates to a lever actuated single cable shift mechanism for an outboard motor and more particularly to an assembly for converting a rotatable tiller handle shift mechanism into a remote lever actuated single cable shift mechanism.

In some relatively small horesepower outboard marine engines, the selection of forward, neutral and reverse and the speed of the engine has been controlled by a rotatable tiller handle. The shift/throttle operation was performed by rotating a cylindrical throttle handle to which a pair of pull-pull cables had been attached. Rotation of the tiller handle would result in a pulling action on one of the cables and the other ends of the cables were attached to throttle and shift mechanisms on the engine.

In some situations, it would be desirable to perform the shift/throttle operation from a steering position usually located well forward of the engine. In order to provide this remote control of the shift/throttle operation, it was necessary to remove the tiller handle and its associated hardware from the engine and then mount a complicated and costly control utilizing two control cables and a control box that duplicated the shift/throttle operation. Such an operation was not only costly and time consuming but was also rather permanent in nature and it did not allow for the quick and easy removal of the outboard engine from the boat once the remote shift/throttle control had been installed.

It is an object of the present invention to provide a single cable shift/throttle assembly that will readily convert a rotatable tiller control into a remote lever actuated single cable shift/throttle control. The assembly also allows tag control cable to be readily removed from the outboard engine so as to allow for a quick and easy removal of the outboard marine engine from the boat.

SUMMARY OF THE INVENTION

The present invention provides a single cable shift assembly for converting a rotatable tiller shift/throttle control to a remote single cable linear actuated control.

In accordance with one aspect of the invention, the assembly is provided with an elongated casing that is mounted on a surface adjacent the exposed cable ends that were utilized with the rotatable tiller handle. The casing is provided with a pair of cable guides that direct the cables in opposite directions along the longitudinal axis of the casing.

In accordance with another aspect of the invention, an elongated slide is mounted for sliding linear movement within the casing and the slide includes a pair of spaced cable anchors for securing the cable ends to the slide at positions spaced along the longitudinal axis of the slide so that linear movement of the slide results in a pulling force on one of the cables.

In accordance with yet another aspect of the invention, the assembly is provided with a connector that secures an end portion of the control cable from the control lever to the slide so that linear movement of the control cable will result in a linear movement of the slide.

In accordance with still another aspect of the invention, the assembly is provided with a locking assembly that releasably maintains the end of the control cable on the connector so that the end of the control cable can be easily removed from the connector thus allowing the engine to be removed from the boat.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
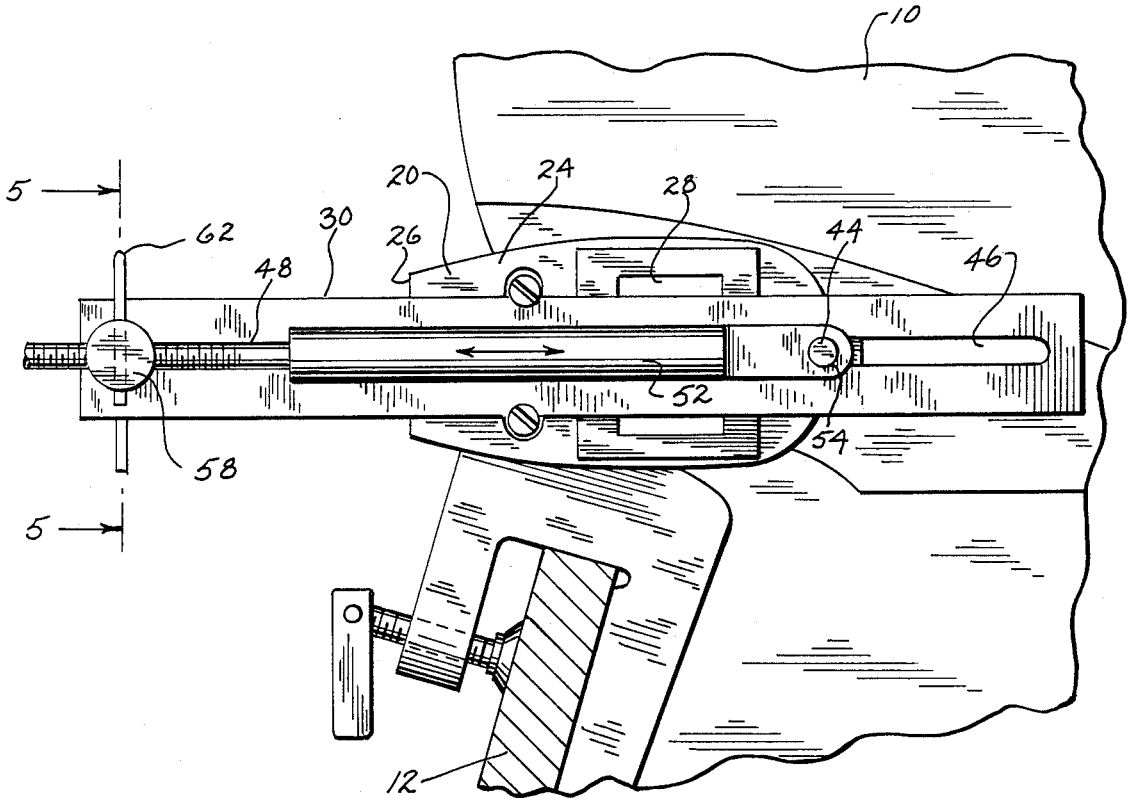
FIG. 1 is a side view of a single cable shift assembly constructed according to the present invention and mounted on an outboard engine.
Figure 5:
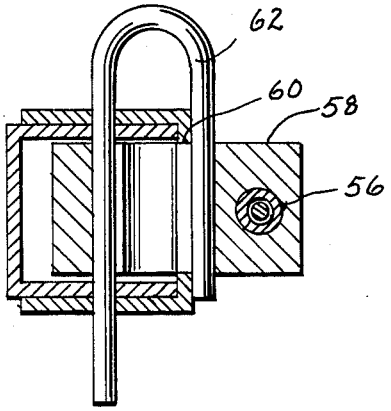
FIG. 5 a sectional view along the line 5—5 of FIG. 1.
Figure 6:
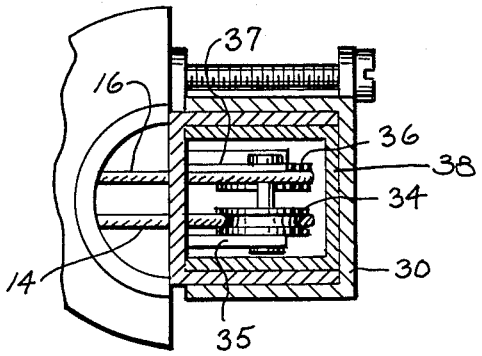
FIG. 6 is a sectional view along the line 6—6 of FIG. 4.
Figure 2:
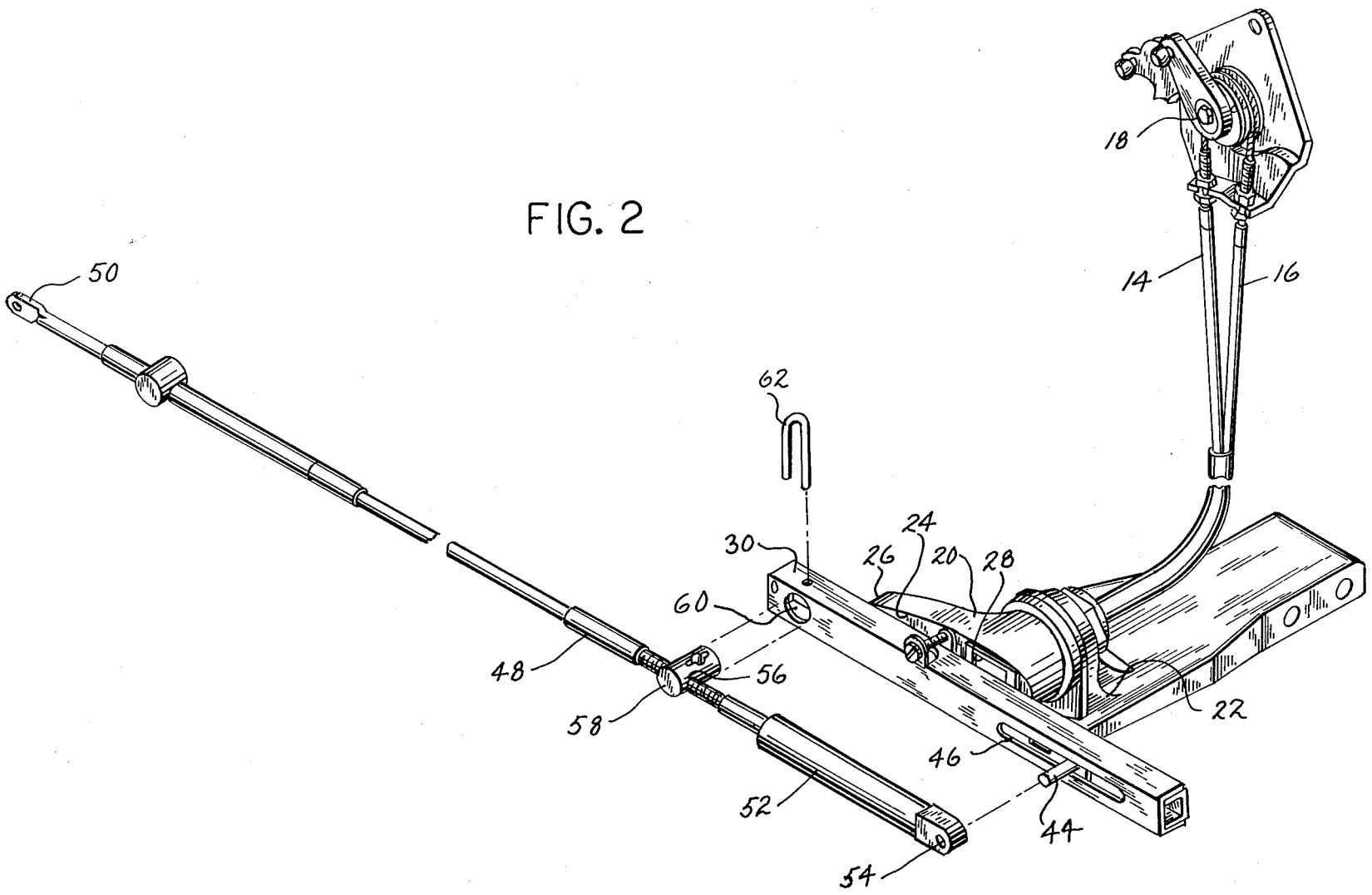
FIG. 2 is a perspective view of the shift assembly of FIG. 1 showing the control cable disengaged from the shift assembly.

As seen in FIGS. 1 and 2, the shift/throttle operation of an outboard marine engine 10 mounted on the transom 12 of a boat is controlled by a pair of pull-pull cables 14 and 16 that are operably connected to a shift/throttle control linkage 18 of engine 10. The opposite ends of cables 14 and 16 extend outwardly through a throttle hub 20 that is pivotally mounted to support 22.

When the typical rotatable tiller handle is utilized, the cable ends are wound about and anchored to the tiller handle and manual rotation of the tiller handle will result in a pulling force on the cables. Typically, the cylindrical tiller handle would be mounted to flat surface 24 on throttle hub 20 and would extend outwardly from surface 26. In FIGS. 1 and 2, the rotatable tiller handle has been removed from throttle hub 20 leaving cables 14 and 16 exposed and extending through opening 28 in throttle hub 20.

Figure 3:
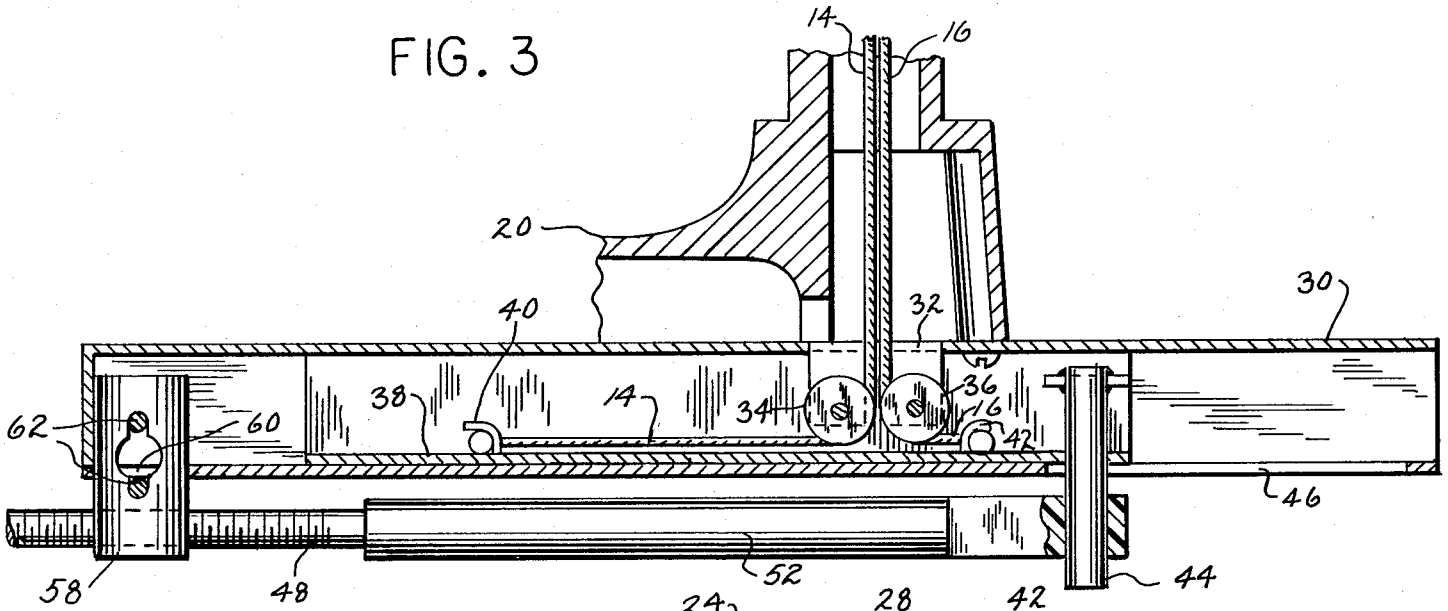
FIG. 3 is a top cross sectional view of the shift assembly.
Figure 4:
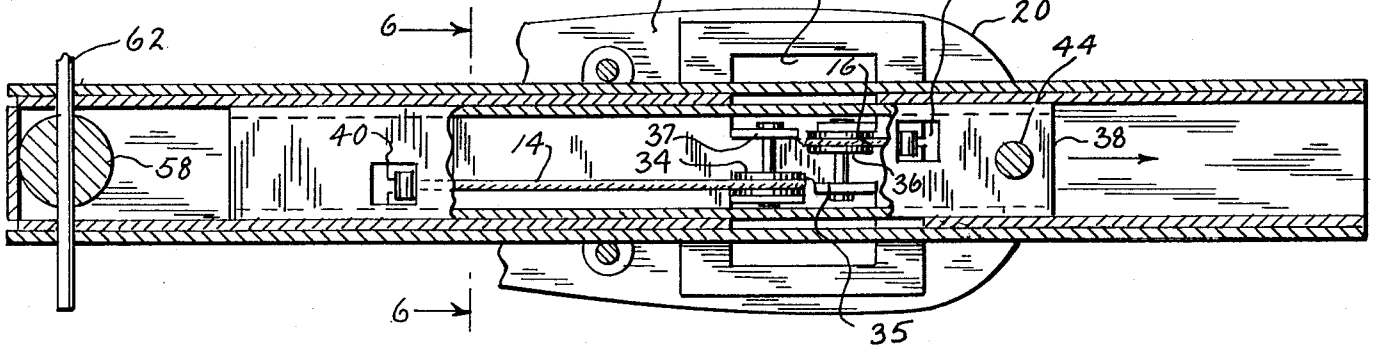
FIG. 4 is a side cross sectional view of the shift assembly.

In order to convert the rotatable shift mechanism to a single cable linear action control, a guide means in the form of an elongated casing 30 has been mounted on the exposed surface 24 of throttle hub 20. As seen in FIG. 3, casing 30 is provided with an opening 32 through which cable ends 14 and 16 pass. Casing 30 is also provided with a pair of cable guides in the form of pulleys 34 and 36. Cable 14 is wound around pulley 34 so as to direct the cable toward one end of casing 30 while cable 16 is wound around pulley 36 so as to direct that cable toward the opposite end of elongated casing 30. A pair of retainer wheels 35 and 37 are provided—one for each of pulleys 34 and 36. Retainer wheels 35 and 37 prevent the disengagement of cables 14 and 16 from pulleys 34 and 36 during assembly.

Disposed within casing 30 is an elongated channel shaped slide 38 disposed so that the opening of the channel is directed towards opening 32 in casing 30. Slide 38 includes a pair of cable anchors 40 and 42 spaced along the longitudinal axis of slide 38. Cable 14 is anchored to slide 38 by cable anchor 40 and cable 16 is anchored to slide 38 by cable anchor 42.

Thus, it can be seen that linear movement of slide 38 in a right to left direction (FIG. 3) will result in a pulling action on cable 14 while linear movement of slide 38 in a left to right direction will result in a pulling force on cable 16.

Slide 38 is provided with a connector pin 44 that extends outwardly from casing 30 through elongated slot 46. Pin 44 serves as the connector between slide 38 and linear control cable 48.

As seen in FIG. 2, linear control cable casing 48 contains a cable (not shown) having a first end 50 which is attached to a customary lever operated control (not shown) and which when actuated causes linear movement of the control cable. The other end of control cable within casing 48 terminates in cable fitting 52 having a hole 54 which is slidably disposed over connector pin 44.

In order to anchor cable 48 and to prevent disengagement of cable fitting 52 from pin 44, control cable casing 48 is passed through a passageway 56 in cylindrical stud 58 and cylindrical stud 58 is inserted into hole 60 in casing 30 and locked into position by means of locking pin 62. When it is desired to remove engine 10 from transom 12, locking pin 62 is removed from stud 58 and stud 58 is lifted from hole 60 which allows cable fitting 52 to be lifted from connector pin 44. Similarly, when engine 10 is replaced on transom 12, the remote shift/throttle control can be reattached by placing hole 54 on cable fitting 52 over connector pin 44 and inserting stud 58 into hole 60 and locking it into place with locking pin 62.

In operation, lever actuated linear movement of the control cable within casing 48 will result in linear movement of connector pin 44 within elongated slot 46 which in turn will result in linear movement of slide 38 within casing 30. This linear movement will result in a pulling force on one of cables 14 or 16 and this will then be communicated to control linkage 18 on engine 10.

The present invention thus provides an inexpensive method of converting a rotatable tiller control to a linear action remote shift/throttle control which may be readily connected to and disconnected from the engine so as to allow for removal of the engine from the boat transom.

It is recognized that various alternatives and modifications are possible in the scope of the appended claims.

I claim:

1. The single cable shift conversion assembly for use with a pair of pull-pull cables, said assembly comprising:

elongated guide means mounted to a surface adjacent the cable ends and having cable guides to direct the cables in opposite directions along its longitudinal axis;

an elongated slide mounted for sliding linear movement on said guide means and having a pair of spaced cable anchors for securing the cable ends to said slide at positions spaced along the longitudinal axis of said slide so that linear movement of said slide in a first direction within said guide means results in a pulling force on one of the cables and linear movement of said slide in a second direction results in a pulling force on the other cable; and connector means for securing an end portion of the control cable to said slide so that linear movement of the control cable results in linear movement of said slide.

2. The single cable shift assembly defined in claim 1 wherein said guide means comprises a casing enclosing said slide means, with said guide means having an opening for passage of the cable ends into said casing and along said cable guides.

3. The single cable shift assembly defined in claim 2 wherein said cable guides comprise a pair of pulleys disposed adjacent said opening with one of the cables wound in a first direction around a first of said pulleys and the other cable wound in a second direction around the second of said pulleys.

4. The single cable shift assembly defined in claim 2 wherein said connector means comprises a pin connected to said slide and extending through an elongated slot in said guide means and said control cable terminates in a fitting having an extension portion including a hole for engagement with said pin.

5. The single cable shift assembly defined in claim 4 further comprising locking means for retaining said control cable fitting in engagement with said pin.

6. The single cable shift assembly defined in claim 5 wherein said locking means comprises a cylindrical stud releasably disposed within a hole in said guide means and extending from said guide means, said stud having a passageway in which the casing for said control cable is disposed so that when said stud is disposed within said guide means said control cable fitting cannot be lifted off said pin and when said stud is removed from said guide means said control cable fitting may be lifted from said pin.

7. A single cable shift conversion assembly for use with a pair of pull-pull cables, said assembly comprising:

an elongated casing mounted to a surface adjacent the cable ends and having an opening for passages of the cable ends into the casing and around a pair of pulleys disposed adjacent the opening in a manner so that one of the cables is directed toward the opposite end of said casing;

an elongated slide mounted for sliding linear movement within said casing and having a pair of spaced cable anchors for securing the cable ends to said slide at positions spaced along the longitudinal axis of said slide so that linear movement of said slide in a first direction within said guide means results in a pulling force on one of the cables and linear movement of said slide in a second direction results in a pulling force on the other cable;

connector means for securing an end portion of the control cable to said slide so that linear movement of the control cable results in linear movement of said slide.

* * * * *

UNITED STATES PATENT AND TRADEMARK OFFICE

CERTIFICATE OF CORRECTION

PATENT NO. : 4,766,776

DATED : August 30, 1988

INVENTOR(S) : Neil A. Newman

It is certified that error appears in the above-identified patent and that said Letters Patent is hereby corrected as shown below:

Column 4, line 44, after "toward" insert

---one end of said casing and the other cable is directed toward---.

Signed and Sealed this

Eighth Day of August, 1989

*Attest:*

DONALD J. QUIGG

*Attesting Officer*

*Commissioner of Patents and Trademarks*